US006705267B1

(12) United States Patent
Westerbeke, Jr. et al.

(10) Patent No.: US 6,705,267 B1
(45) Date of Patent: Mar. 16, 2004

(54) COMBUSTION ENGINES

(75) Inventors: John H. Westerbeke, Jr., Milton, MA (US); Erik S. Larson, Norwood, MA (US)

(73) Assignee: Westerbeke Corporation, Taunton, MA (US)

( * ) Notice: Subject to any disclaimer, the term of this patent is extended or adjusted under 35 U.S.C. 154(b) by 0 days.

(21) Appl. No.: 09/862,565

(22) Filed: May 22, 2001

Related U.S. Application Data

(63) Continuation-in-part of application No. 09/835,277, filed on Apr. 13, 2001.

(60) Provisional application No. 60/197,831, filed on Apr. 14, 2000, and provisional application No. 60/206,051, filed on May 22, 2000.

(51) Int. Cl.[7] ..... F02M 35/10

(52) U.S. Cl. ..... 123/184.53; 123/184.57; 261/72.1

(58) Field of Search ..... 123/184.53, 184.39, 123/184.23, 184.46, 184.57, 198 D; 181/212; 261/72.1, 18 A, 142, 151, 145, 78.1, 37

(56) References Cited

U.S. PATENT DOCUMENTS 2,867,423 A * 1/1959 Wing ..... 261/43
3,778,024 A * 12/1973 Rogerson ..... 251/63
3,904,712 A * 9/1975 Taylor ..... 261/34.2
5,596,962 A * 1/1997 Tsunoda et al. ..... 123/184.39

* cited by examiner

*Primary Examiner*—Tony M. Argenbright
*Assistant Examiner*—Katrina Harris
(74) *Attorney, Agent, or Firm*—Fish & Richardson P.C.

(57) ABSTRACT

Engine safety features include an intake silencer defining an internal volume sized to help attenuate air pressure fluctuations generated within the carburetor and engine and transmitted back through the entering combustion air, and also functions as a flame arrester. An internal drip well collects fuel droplets to be siphoned through a hose back to the engine intake system for combustion. The carburetor bowl operates to allow gas and relatively safe vapor out of the carburetor during venting, but disallows liquid fuel from flowing out of the carburetor through the vent. A ball check valve drain disposed in an air intake enables suction of liquid fuel from the silencer into the intake manifold but inhibits suction of air. These features are useful modifications of commercially available engines to improve their suitability for marine applications such as on board electrical power generation, for example.

12 Claims, 7 Drawing Sheets

14
29
20
6
6

14
18
24
26
7
7
16
29

14
29
20
26
24

29
24
14
20

14
29
22
18
20
24

20
18
16
24
14

14
29
24
20
22
18

COMBUSTION ENGINES

RELATED APPLICATIONS

This application claims priority to U.S. provisional application No. 60/206,051 filed on May 22, 2000, U.S. provisional application No. 60/197,831 filed Apr. 14, 2000, and is a continuation-in-part U.S. application Ser. No. 09/835,277 filed Apr. 13, 2001, the contents of which are incorporated herein by reference.

TECHNICAL FIELD

This invention relates generally to combustion engines, and more particularly to increasing the safety and performance of engines used for marine applications.

BACKGROUND

Many types and models of engines are commercially available for integration into power systems for a variety of applications. One line of such engines is the DM700G/DM950G series available from Briggs&Stratton-Daihatsu. For some applications, such as providing propulsion or secondary power generation on boats, particularly stringent safety requirements are demanded by law. In the case of marine engines, the performance of safety systems is specified in the United States by the U.S. Coast Guard. For example, 33 C.F.R. §183.526 specifies a fuel leakage test for carburetors of marine engines. To pass such tests, commercially available engines are typically modified to run any carburetor bowl vent to the intake manifold to avoid leaking any liquid fuel such as, for example, when the throttle is opened with the carburetor float stuck.

In most applications, it is also desirable that engines perform with as little audible noise as possible. This is especially true for electrical power generation on boats, as such generator systems frequently operate in an absence of background noise.

Other desirable engine attributes include low emission of pollutants and high fuel efficiency.

SUMMARY

The invention features several improvements in the design and structure of engines that, for example, improve their suitability for marine applications such as on board electrical power generation.

One such improvement is an intake silencer for use with side-draft carburetors. The intake silencer of the invention defines an internal volume sized to help attenuate air pressure fluctuations generated within the carburetor and engine and transmitted back through the entering combustion air, and also functions as a flame arrester to inhibit the propagation of sparks or flame from the carburetor to the surrounding atmosphere.

In some embodiments, the intake silencer also defines an internal drip well at the bottom of its internal volume to collect fuel droplets and condensing vapors during, for example, the carburetor leak test specified in 33 C.F.R. §183.526. Preferably, these collected liquids are siphoned through a hose back to the engine intake system for combustion.

In the present embodiment, the intake silencer defines an attachment at one end for a tuned pipe or "zip tube", in hydraulic communication with the internal volume of the silencer, to provide a quarter-wavelength attenuator.

Another such improvement deals with carburetor bowl venting. Instead of suctioning carburetor bowl gasses into the intake manifold at negative gage pressure, as has been done in marine applications employing commercially available engines, in the improved engine the carburetor bowl is vented to the atmosphere through a check valve that operates to allow gas and relatively safe vapor out of the carburetor during venting, but disallows liquid fuel from flowing out of the carburetor through the vent. In early tests, this improvement was able to significantly reduce the emissions of the engine under some operating conditions, as compared with the same engine with the carburetor bowl vented into the carburetor inlet.

In another aspect, the invention features an air intake component, such as a silencer or air filter housing, adapted to be attached to a carburetor and including a check drain valve hydraulically connecting the component to the intake manifold of the engine. The drain valve enables liquid fuel to be sucked into the engine from the component but inhibits the transfer of air. In one embodiment the valve includes a check ball that normally seats against the inner surface of the drain to prevent the flow of air into the manifold under manifold vacuum pressure. The ball is constructed to float on liquid fuel, such that in the presence of a sufficient quantity of liquid fuel the ball will rise from its seat and permit the liquid fuel to be sucked into the manifold. This valve is particularly effective for use with engines equipped with side draft carburetors attached to intake components, upstream of the carburetor, with inner cavities that extend to a lower elevation than the carburetor inlet and can therefore tend to collect liquid fuel.

Another engine improvement features a damper applied to an engine speed control linkage to dampen linkage oscillation and improve engine speed stability. We have found that connecting the governor speed control lever of certain commercially available engines to the associated engine block with a dashpot can dampen the speed oscillations experienced during a rapid load change without significantly impairing engine speed response time. This improvement is particularly useful for engines coupled to electrical generators or otherwise intended to operate at a fairly constant speed for an extended period of time. For driving AC generators, engine speed stability is extremely necessary for maintaining generator frequency, as well as output voltage stability. We have found, for instance, that proper dashpot and spring selection can improve the suitability of Daihatsu DM700G/DM950G series engines for driving AC generators.

The details of one or more embodiments of these improvements are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
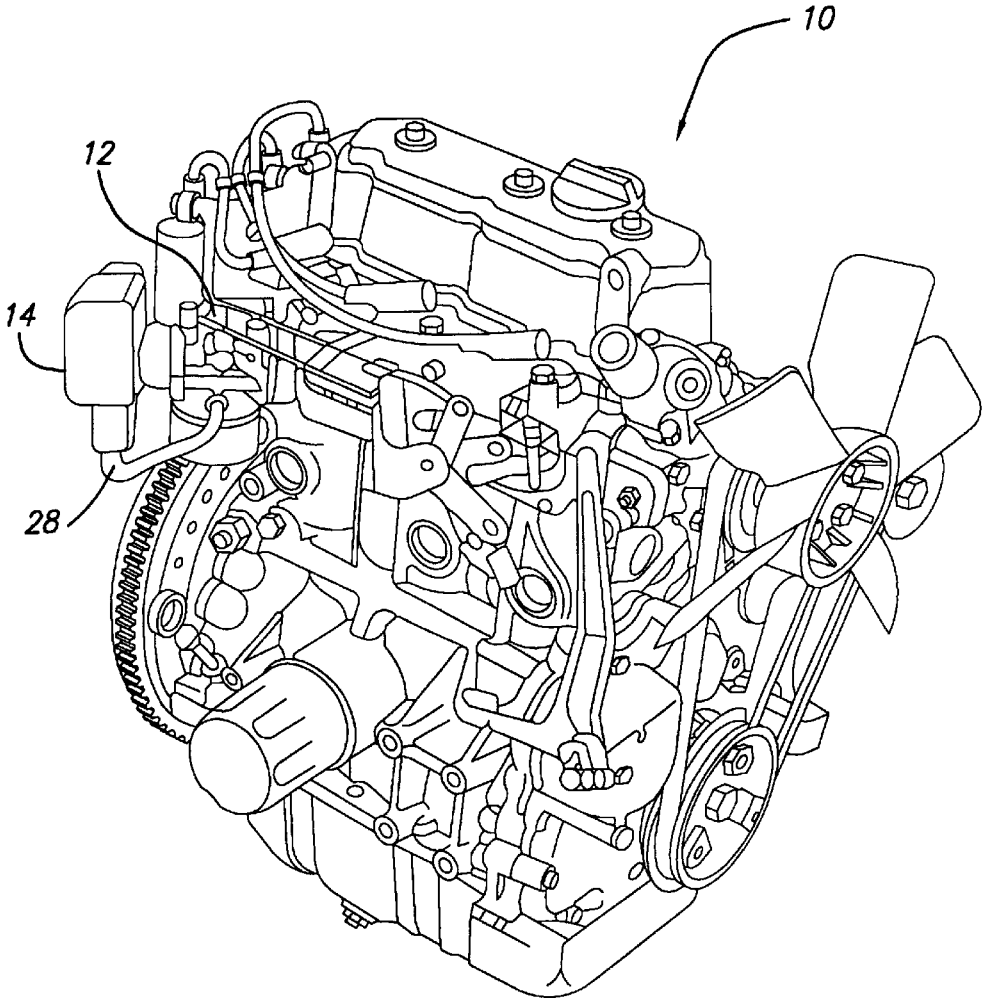
FIG. 1 is an internal combustion engine equipped with an intake silencer.
Figures 2, 3, 4, 5, 6, 7, 8:
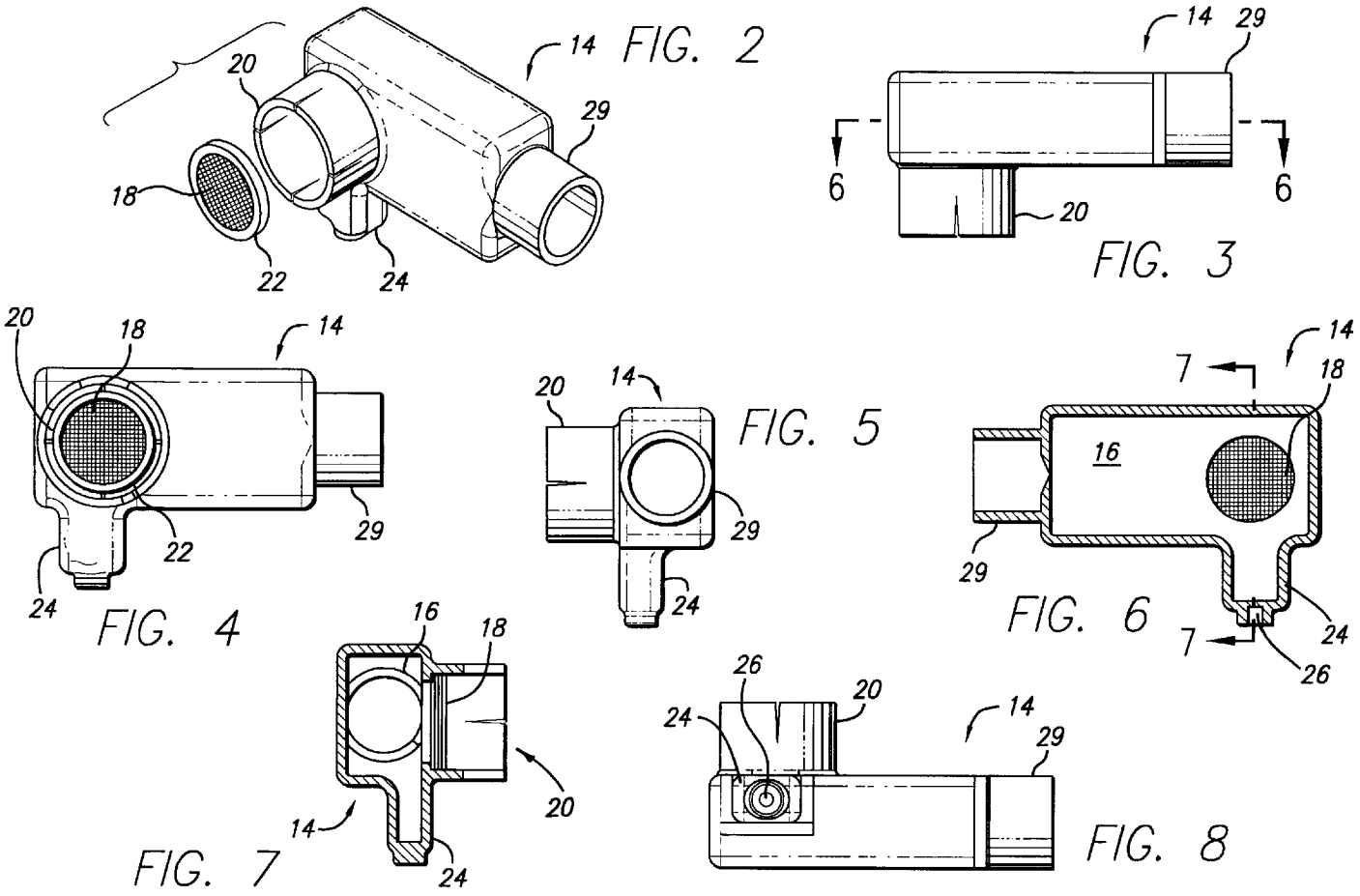
FIG. 2 is a perspective view of the intake silencer.
FIGS. 3–5 are top, front and side views, respectively, of the intake silencer.
FIG. 6 is a cross-sectional view, taken along line 6—6 in FIG. 3.
FIG. 7 is a cross-sectional view, taken along line 7—7 in FIG. 6.
FIG. 8 is a bottom view of the intake silencer.

Referring to FIG. 1, a gasoline engine 10 has a carburetor 12 for supplying a predetermined air/fuel mixture for combustion. Air is provided through an intake silencer 14.

Referring also to FIGS. 2–8, silencer 14 is a one-piece cast aluminum housing defining an internal volume 16 of roughly 2.5 inches by 1.5 inches by 5.5 inches. A metal screen 18 is provided in the outlet 20 of the silencer, where the silencer attaches to the side draft inlet of the carburetor (not shown). The metal screen 18 functions as a spark arrester for inhibiting flame propagation from the carburetor back into the silencer. Screen 18 is mounted in a rim 22 that, once installed to the carburetor, is clamped between an inner lip of the silencer housing and the inlet nozzle of the carburetor.

A particular advantage of this embodiment is that the spark arrester (screen 18) is completely enclosed within the silencer housing. Thus, in one single casting silencer 14 performs both a noise reduction function and a fire safety function.

Of course, the optimal size and shape of the internal volume of the silencer will vary with different engines and different operating speeds. For fixed speed applications, such as for driving synchronous generators, the size of the internal cavity should be selected for a satisfactory level of airborne noise at the known operating speed. We have found that this illustrated embodiment works well for the Daihatsu engines mentioned above, when run at a speed of about 1800 RPM.

Extending from the bottom side of silencer 14 is an internal drip well 24 disposed immediately below outlet 20 to catch any fuel droplets entering the silencer from the carburetor. A recirculation port 26 provides a connection for a recirculation hose 28 (FIG. 1) for siphoning caught fuel to the intake manifold. We have found only a minor reduction in manifold vacuum, even with a recirculation port of as much as 0.25 inch in diameter.

Silencer 14 also defines an air inlet 29 to which a "zip tube" can be readily attached for supplying fresh air for combustion. Neither the volume of the inlet 29, nor the volume of the outlet 20, is included in the internal volume of the silencer when discussed in terms of noise attenuation.

Figure 9:
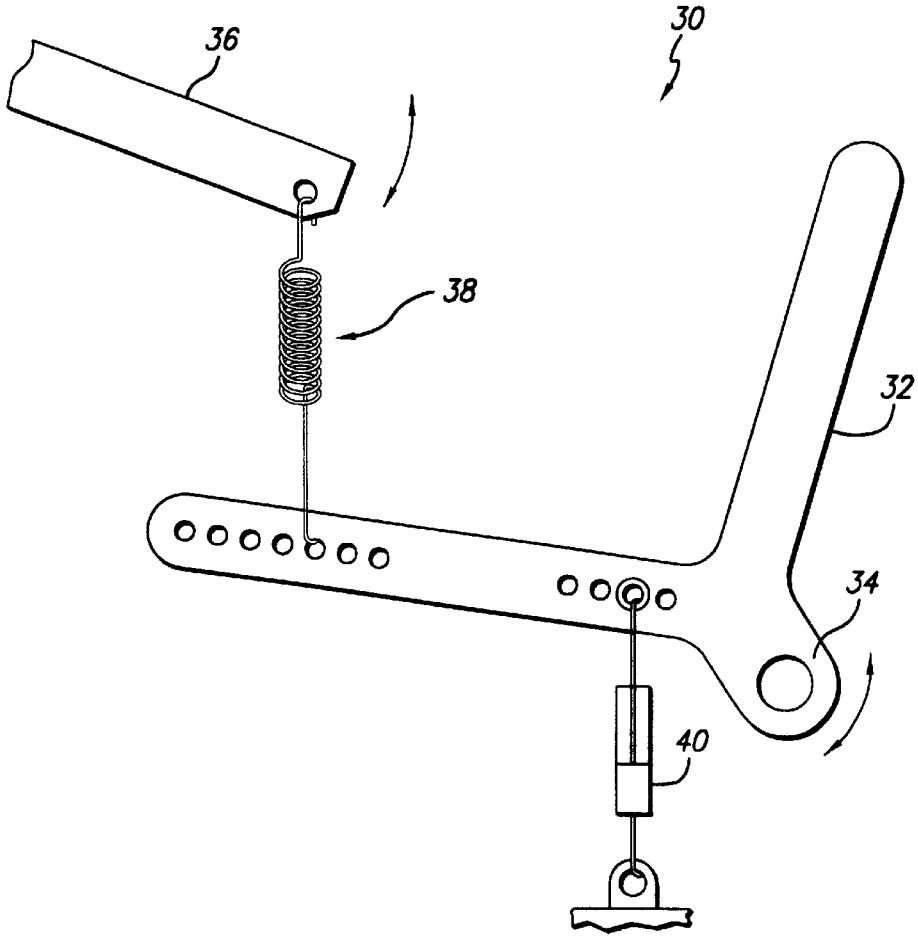
FIG. 9 illustrates a governor speed control linkage equipped with a dashpot.

Referring to FIG. 9, an engine speed control linkage 30 includes a pivot lever 32 fixed to a governor control shaft 34 and adapted to rotate shaft 34 when pivoted about the centerline of the shaft, to adjust the rotational position of the shaft and thereby adjust the speed setting for the mechanical engine governor (not shown). The speed setting is controlled through the positioning of lever 36, which is attached to lever 32 by extension spring 38. Thus, a clockwise control torque is applied to lever 32 by spring 38 as a function of the relative positions of the two levers. Counter-acting, counter-clockwise torque is provided by the centripetal acceleration of the flyweights of the governor. Levers 32 and 36 and spring 38 are members of an engine speed control linkage of the line of Daihatsu engines noted above. We have found that adding a dashpot 40 between lever 32 and a fixed point on the engine block improves the stability of engine speed, particularly during load changes. In effect, dashpot 40 acts to dampen the higher frequency content of oscillation of lever 32, resulting in more speed stability and less 'hunting'. This is particularly important for applications in which the engine is intended to operate at fairly constant speeds and in which a fast speed change response characteristic is therefore of less importance. In the arrangement illustrated and tested, spring 38 has an extension spring rate of about 1.1 pounds per inch, and dashpot 40 is as purchased from Airpot Corporation, Norwalk, Conn., as their part number 2KS95. Spring 38 was attached to lever 32 at a point about 3.5 inches from the center of shaft 34, and dashpot 40 was attached at a point about 1.75 inches from the center of shaft 34.

Figure 10:
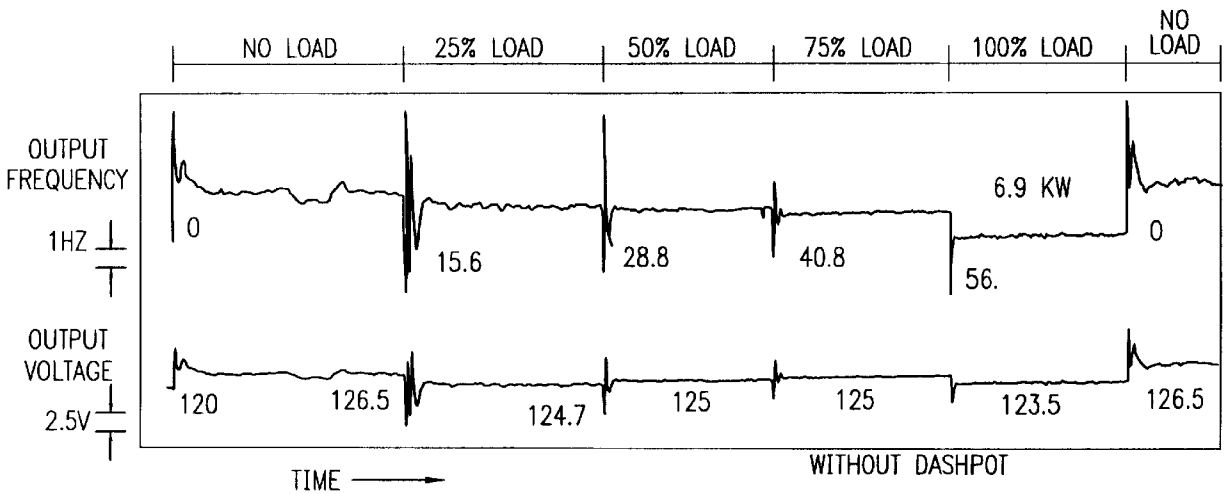
FIG. 10 documents a test of engine speed stability without the dashpot.

FIG. 10 shows a load response test conducted on a Daihatsu engine connected to an electrical generator, without the control linkage as shown in FIG. 9 but without dashpot 40. The upper time trace is of generator output frequency, representative of engine speed. The lower trace is of generator output voltage. As indicated above the traces, the first time period of the test was with the generator at effectively no load. At approximately one minute intervals, the load was increased in 25% increments up to effectively 100% rated load, then returned to no load. Of particular interest are the underdamped speed fluctuations occurring at the load transition points, resulting in oscillations in both frequency and voltage. While some speed variation is expected with rapid load changes, it is desirable to minimize such speed fluctuation as much as possible, such that engine speed is as independent of load as possible.

Figure 11:
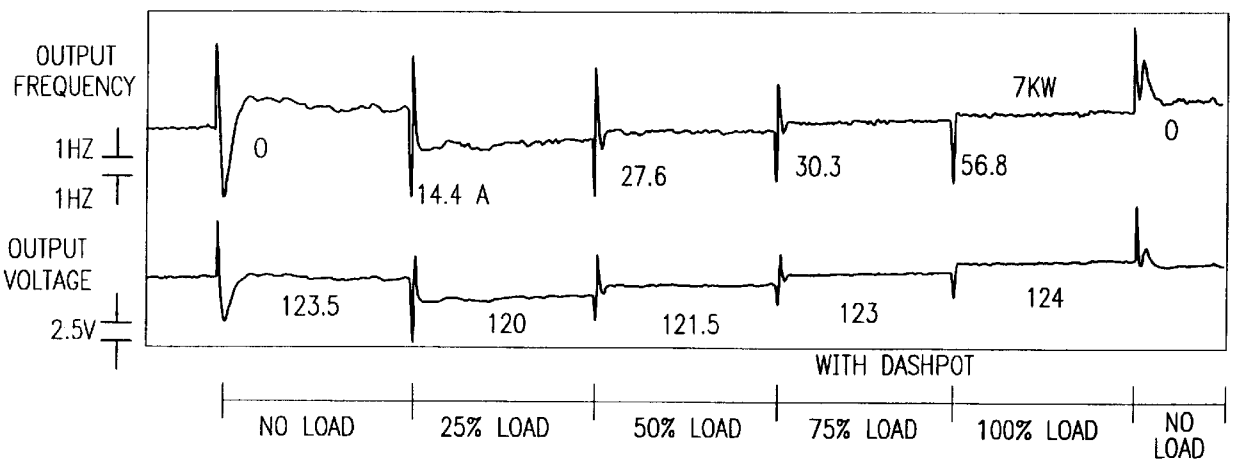
FIG. 11 documents a test of engine speed stability with the dashpot.

FIG. 11 is from a similar test of the same engine tested in FIG. 10, but with the engine speed control linkage equipped with dashpot 40 as shown in FIG. 9. Comparing FIGS. 10 and 11, it can be seen that the presence of the dashpot dampened the speed oscillations occurring at rapid load changes, without significantly increasing response time. For example, at point 42, the increase from no load to 25% load, the standard engine speed went through two complete oscillations before settling, whereas the dashpot-equipped engine settled after only one speed oscillation.

Figure 12:
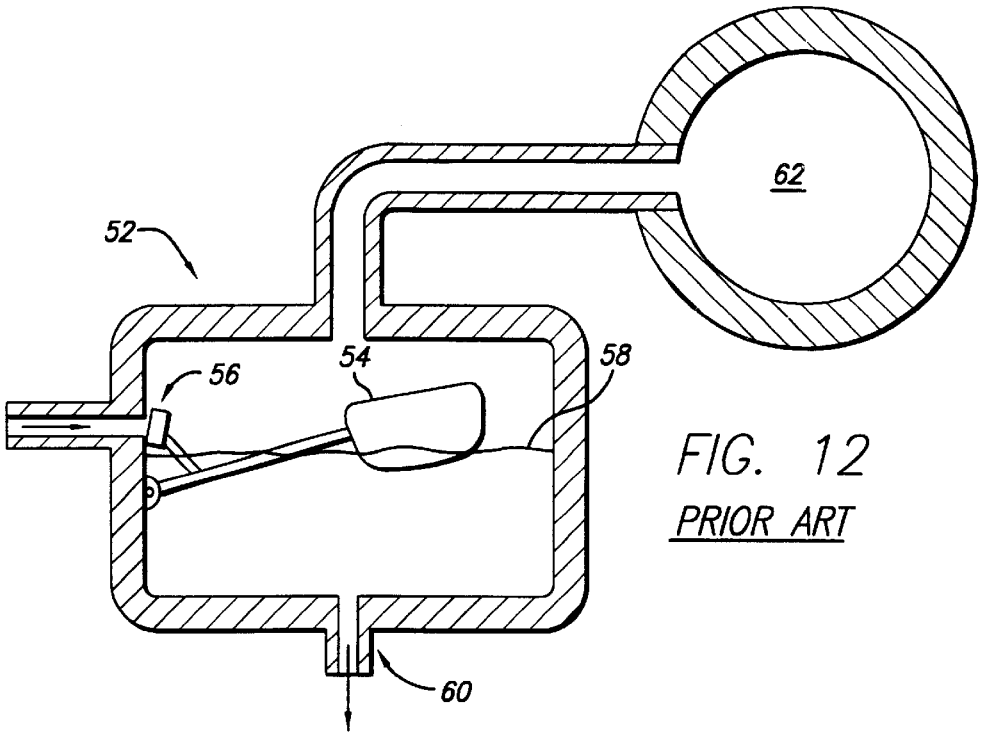
FIG. 12 PRIOR ART
FIG. 12 schematically illustrates a prior art method of venting a carburetor float bowl.

Referring now to FIG. 12, a float chamber 52 of a typical carburetion system, as previously modified for marine applications, is schematically represented. A float 54 moves to operate a valve 56 to regulate the level of liquid fuel 58 within the chamber, which is fed to the mixing chamber through port 60. Air displaced from chamber 52 is vented into the engine's intake manifold 62 or carburetor inlet. While this venting method keeps liquid fuel from leaking from the system when float chamber 52 is inadvertently flooded, the vacuum pressure in manifold 62 can also draw excess fuel vapor or even unregulated liquid fuel into the intake of the engine, thus causing an undesirably "rich" fuel mixture that can negatively affect performance and emissions.

Figure 13:
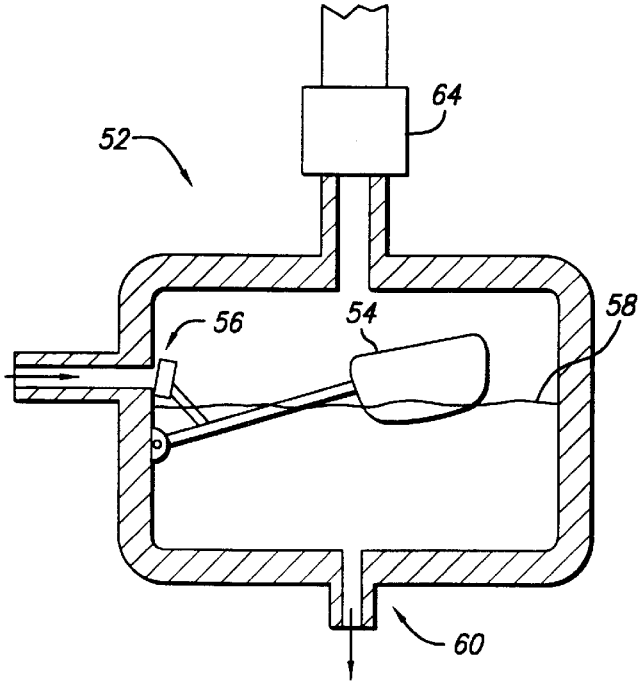
FIG. 13 schematically illustrates venting a carburetor float bowl through a check valve.

As shown in FIG. 13, we have found that safe float chamber venting may be accomplished by venting the float chamber 52' to the atmosphere through a ball check valve 64. The function of valve 64 is to inhibit the release of liquid fuel from chamber 52' under all conditions, but to enable the venting of harmless amounts of air and vapor. We have found that, under normal operating conditions, the same Daihatsu engine vented as shown in FIG. 13 produced significantly less emissions than when equipped as shown in FIG. 12.

Figure 14A:
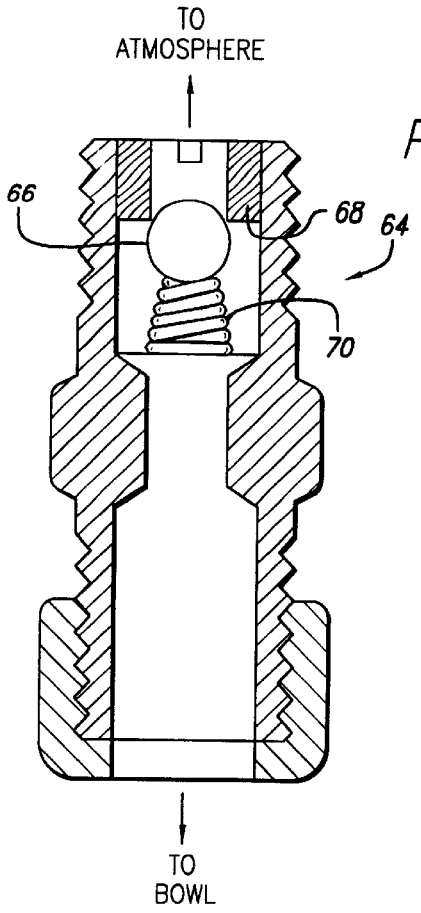
FIGS. 14A and 14B illustrate examples of applicable check valves.

Ball check valve 64 may be, for example, a "WEATHERHEAD" brass male ball check connector, available from Dana Corporation, Cleveland, Ohio, as catalog number 43X4 and as shown in FIG. 14A, for example. In such a valve, oriented such that the ball end is up, a ball 66 is urged toward a fixed seat 68 by a compression spring 70. With air or vapor at the interface between seat 68 and ball 66, there is sufficient leakage about the ball to permit venting of the carburetor bowl through the valve. However, if the level of liquid fuel rises to the interface between seat 68 and ball 66, the ball/seat interface provides sufficient restriction against upward flow to enable fuel pressure to build under the ball and effectively seal the ball/seat interface against liquid fuel flow. When the liquid fuel level subsequently drops, air and vapor venting is resumed.

The valve 64 shown in FIG. 14A may be modified to replace the solid metal ball 66 and spring 70 with a ball 66 adapted to float upward on a rising level of liquid fuel to engage seat 68 to close the valve, but otherwise to remain generally spaced away from seat 68 to allow venting of air and vapor at reasonable air and vapor flow rates. Such characteristics may be obtained by designing such a ball to have an appropriate combination of buoyancy and weight, for example.

Figure 14B:
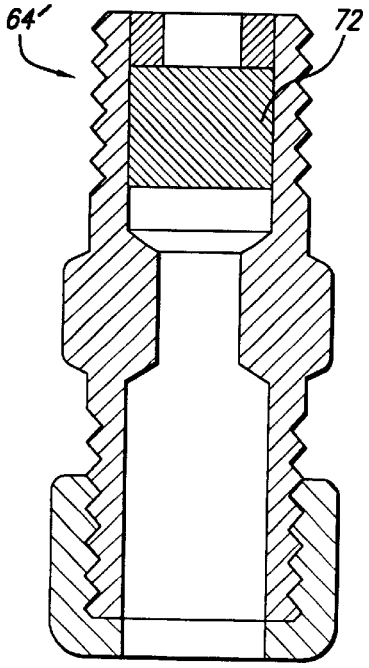

Alternatively, a membrane valve 64' may be provided as shown in FIG. 14B. Instead of a ball and spring, a porous membrane 72 is constructed to permit air and some amount of vapor to pass while blocking liquid fuel in droplet or flow form. It is important that membrane 72 be constructed to withstand fuel pump pressures without rupturing.

Figure 15:
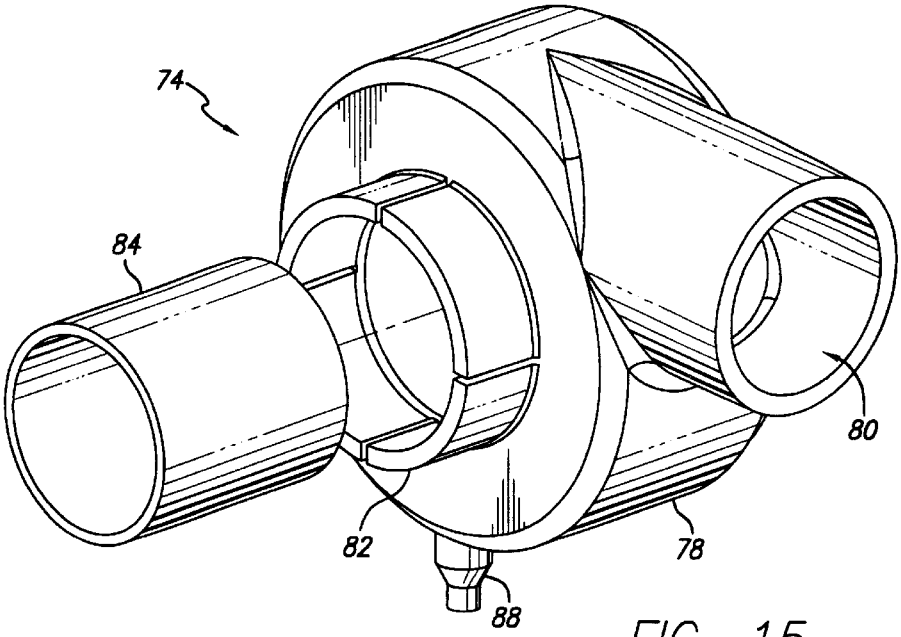
FIGS. 15 and 16 are perspective and side views, respectively, of another intake silencer, equipped with a cylindrical spark arrester and a drain check valve.
Figure 17:
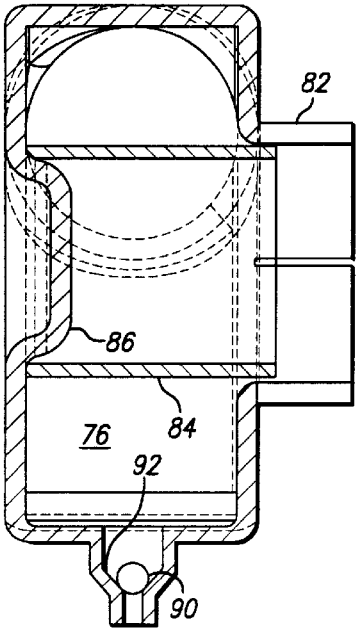
FIG. 17 is a cross-sectional view. taken along line 17—17 in FIG. 16.
Figure 16:
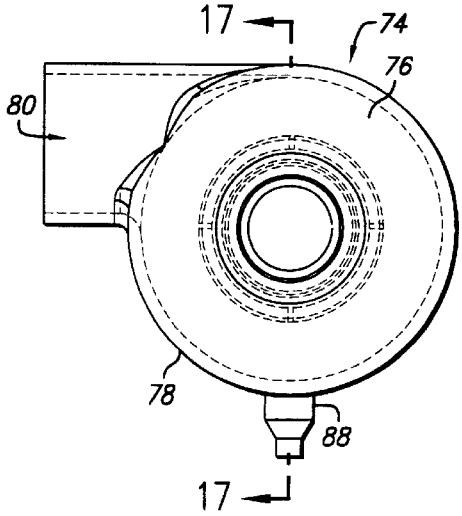

Referring now to FIGS. 15–17, intake silencer 74 provides intake air to a carburetor of a gasoline engine, and defines an internal cavity 76 sized to dampen pressure vibrations that can result in undesirable, air-borne noise. The silencer has a cast aluminum housing 78 with an intake port 80 and a flange 82 for mounting the silencer to a carburetor (not shown). A cylindrical flame arrester screen 84 is held in place within the silencer by flange 82 and a cast protrusion 86 extending inward from the outer side of the silencer, as shown in FIG. 17. Screen 84 serves to inhibit the propagation of flame or sparks from the carburetor throat to atmosphere through the silencer. Housing 78 is also equipped with a drain 88 at the low point of cavity 76 for draining any condensed or otherwise accumulated fuel from the silencer. The drain is hydraulically connected, through an appropriate hose, to the intake manifold of the engine (not shown), such that under normal operating conditions the output of drain 88 is at negative (i.e., vacuum) pressure.

To keep atmospheric air from being sucked directly into the intake manifold from drain 88, a check ball 90, of a diameter larger than the smallest diameter of the drain opening of housing 78, normally rests against a tapered surface 92 within the drain. Thus, drain 88 acts as a check valve against the flow of air from the silencer into the engine manifold. However, ball 90 is constructed to float on the liquid fuel that accumulates in drain 88, such that in the presence of liquid fuel ball 90 will rise from surface 92 and allow the fuel to be sucked into the engine manifold. When the fuel is no longer present, ball 90 returns to its seat to inhibit flow of air. One presently preferred embodiment employs a ¼ inch diameter hollow ball of polypropylene. Thus, drain 88 prevents the undesirable release of liquid fuel from the engine due to prolonged accumulation within the intake silencer. As mentioned above, this is particularly important for engines operating in regulated environments, such as aboard boats. It will be understood from this disclosure that drain 88 is also useful on other air intake components other than silencers, such as air filter housings.

A number of embodiments of the invention have been described. Nevertheless, it will be understood that various modifications may be made without departing from the spirit and scope of the invention. Accordingly, other embodiments are within the scope of the following claims.

What is claimed is:

1. A carburetor bowl vent comprising: a valve arranged for hydraulic communication between a carburetor bowl of an engine and surrounding atmosphere, the valve adapted to allow gas and vapor to pass from the carburetor bowl to atmosphere during normal operation, and to disallow liquid fuel from flowing out of the carburetor through the valve;

a housing defining an internal cavity for hydraulic communication through the valve, and a porous membrane disposed within and across the cavity, the membrane adapted to permit leakage of air through the valve at normal venting flow rates while inhibiting flow of liquid fuel.

2. The carburetor bowl vent of claim 1 wherein the valve contains a ball seat disposed at one end of an internal cavity, a ball disposed within the internal cavity, and a spring arranged to urge the ball against the ball seat, the ball and seat defining an interface that enables leakage of air and vapor through the valve at normal venting flow rates while inhibiting flow of liquid fuel.

3. The carburetor bowl vent of claim 1 further comprising an intake silencer for use with a side-draft carburetor on an engine, the intake silencer having a housing defining an internal volume sized to reduce air pressure fluctuations generated within the carburetor and engine, the silencer also comprising a flame arrester attached to the housing and adapted to inhibit propagation of flame from the carburetor to surrounding atmosphere.

4. The carburetor bowl vent of claim 3 further comprising an attachment at one end of the housing for securing a tuned pipe in hydraulic communication with the internal volume of the silencer, to provide a quarter-wavelength attenuator.

5. The carburetor bowl vent of claim 3 wherein the housing also defines an internal drip well disposed at the bottom of the internal volume to collect fuel droplets and condensing vapors.

6. The carburetor bowl vent of claim 5 defining an outlet through the housing at the drip well for siphoning collected liquid from the drip well through an attached hose back to an intake system of the engine for combustion.

7. The carburetor bowl vent of claim 5 wherein the flame arrestor comprises a metal screen for inhibiting propagation from the carburetor back into the silencer.

8. The carburetor bowl vent of claim 5 wherein the flame arrestor is disposed completely within the housing.

9. The carburetor bowl vent of claim 3 wherein the flame arrester is disposed within the housing of the silencer.

10. The carburetor bowl vent of claim 1 adapted for use with a marine engine aboard a vessel.

11. The carburetor bowl vent of claim 10 wherein the engine is connected to an electric generator.

12. The carburetor bowl vent of claim 10 wherein the engine provides propulsion to the vessel.

* * * * *